US005165785A

United States Patent [19]

Doong

[11] Patent Number: 5,165,785

[45] Date of Patent: Nov. 24, 1992

[54] FLOOR LAMP DIMMER

[76] Inventor: Paul Doong, No. 88, Ping Ho Rd., Chungho, Taipei, Taiwan

[21] Appl. No.: 832,324

[22] Filed: Feb. 7, 1992

[51] Int. Cl.[5] ..... F21V 23/00

[52] U.S. Cl. ..... 362/295; 362/395

[58] Field of Search ..... 362/800, 295, 395, 394, 362/411

[56] References Cited

U.S. PATENT DOCUMENTS 1,208,682 12/1916 Spielman ..... 362/295
5,023,522 6/1991 Mansour ..... 362/395

FOREIGN PATENT DOCUMENTS 144070 11/1979 Japan ..... 362/295

*Primary Examiner*—James C. Yeung

*Attorney, Agent, or Firm*—Bacon & Thomas

[57] ABSTRACT

The invention herein relates to a kind of improved floor lamp dimmer and the improvements include the electronic components required by the dimmer circuit enclosed in an oblong case, which is then installed inside the column of the floor lamp; moreover, there is a slot in the case and the column for the placement of an operating bolt which is linked to slide-type lever of the rheostat; the aforementioned operating bolt can be moved upward and downward along the the outside of the floor lamp column, thereby serving as the power switch and brightness adjuster; the dimmer is enhanced in that the design includes an LED indicator which is connected to the electrical circuit of the floor lamp and is capable of outputting a light signal, thereby making it possible to find the location of the dimmer in the dark.

6 Claims, 6 Drawing Sheets

FLOOR LAMP DIMMER

FIELD OF THE INVENTION

The invention herein relates to a kind of improved dimmer built into the hollow cavity of the main support column of a floor lamp, which also emits a visible signal that enables the locating of the aforesaid dimmer in the dark.

BACKGROUND OF THE INVENTION

The conventional floor lamp is commonly placed in the living room, entrance ways or corner of a room to provide lighting and interior atmosphere; in addition to utilization as a source of illumination, the floor lamp also serves as an elegant decorative object reflecting the ultimate in high-class living. Therefore, the exterior design of a floor lamp is obviously of extreme importance.

Referring to the floor lamp (10) in FIG. 1, the main components are the base (11), column (12) and lamp shade (13); of these, modifications to the base (11) and the lamp shade (13) have the most influence on outward appearance and futhermore, since only the column (12) is a completely functional component, the column tends to remain tubular as commonly seen in the construction of most conventional floor lamps.

In terms of other aspects, a conventional floor lamp is ordinarily equipped with an dimmer to provide electrical current switching and variable illumination. In general, there are two types of conventional dimmers; the example type indicated in FIG. 1 is normally mounted in the column (12) (usually at a distance from the floor enabling convenient operation by the extended arm of a standing adult). As further indicated in FIG. 2, the overall physical dimensions of the electronic components on the dimmer sub-assembly (14) are subject to space limitations (such as in the case of the potentiometer (15) and other electronic components not shown in FIG. 2) and this also applies to the height of the knob (16) as well as other factors; thus, there is always the limitation that electronic components of the most compact physical dimension be selected. Due to the preceding situation, the inner diameter of the column (12) must be large enough to permit the insertion of the dimmer sub-assembly (14) into the column (12). Since the initial development of the floor lamp up until the present day (the floor lamp is now considered a mature product), the minimum inner diameter of the column had to measure 1.5 inches (38.1 mm) in order to provide the requisite space for installing the dimmer and, under this condition, since this precludes the utilization of a column with an inner diameter smaller than the aforestated dimensions, the further development of the floor lamp has been hampered.

In addition, the aforementioned dimmer sub-assembly (14) has an operating knob (16) which protrudes through the wall of the column (12) (refer to FIG. 1 and FIG. 2). Since the operating knob (16) protrudes in such an inelegant manner, there is an abrupt projection emerging from the surface of the column (12), with the effect resulting in a blemish and visible aberration that is unavoidable in the design of the column segment (10) of the floor lamp.

The second type of conventional dimmer is independent of the floor lamp itself and is usually connected to the floor lamp via a length of wire. This type of externally connected dimmer allows the utilization of a smaller inner diameter column during the designing of a floor lamp since there are no restrictions with regard to column dimensions, thus facilitating the design of floor lamps with a range of different column sizes as required to conform with marketing trends because the disadvantage of having to insert a dimmer sub-assembly into a tubular column with a minimum diameter of 1.5 inches has been solved; however, this type of externally connected dimmer is not totally free of shortcomings, since the dimmer is separated from the floor lamp, there are no provisions for permanently positioning the dimmer, thus raising the possibility of inconvenience, which will become most apparent when the dimmer is sought by fruitlessly groping in the dark.

SUMMARY OF THE INVENTION

The purpose of the invention herein is to eliminate the drawbacks of conventional floor lamps now in current use by offering a type of improved dimmer that can be placed into columns with differing inner diameters, thereby removing the diameter size limitation of floor lamp columns and thus increasing the relative scope of floor lamp design.

The primary objective of the invention herein is to offer a kind of improved dimmer with an operating tab on the floor lamp column which can be quickly located, yet subtle enough to remain unnoticed in order to maintain the attractiveness of the floor lamp.

Another specific objective of the invention herein is to offer a kind of improved dimmer that has a built-in LED indicator light which emits a luminous signal to show the exact location of the dimmer in the dark.

The dimmer offered by the invention herein includes a long internal case enclosing the dimmer circuit, wherein slots of matching length are cut into the surfaces of the column and the aforementioned container to permit the passing through of an operating bolt which is linked to a rheostat, with the aforesaid operating bolt capable of being slid upward and downward along the outer wall of the column to serve as a switch and brightness adjuster. The aforementioned dimmer circuit also includes an indicator light which emits a visible signal which shows the exact location of the dimmer in the dark.

A more complete understanding of the other objectives and unique innovations of the invention herein can be obtained by perusing the drawings and accompanying explanatory details.

DETAILED DESCRIPTION OF THE PREFERRED EMBODIMENT

Figure 1:
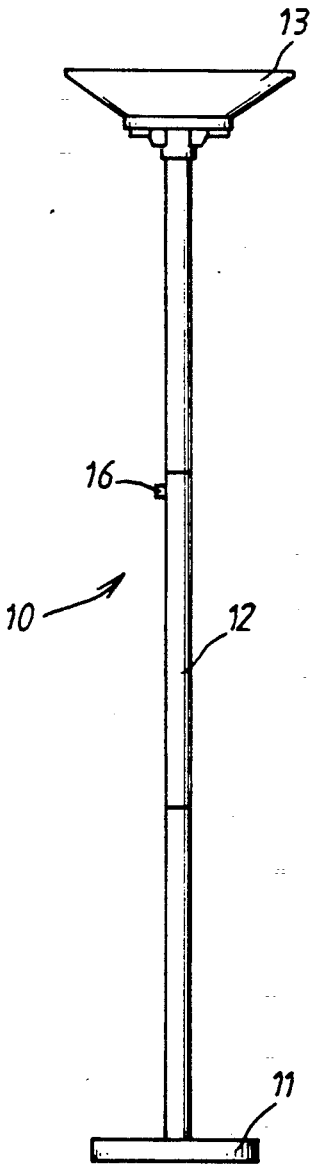
FIG.1 (PRIOR ART)
FIG. 1 is an orthographic drawing of a conventional floor lamp with a knob-type dimmer.
Figure 2:
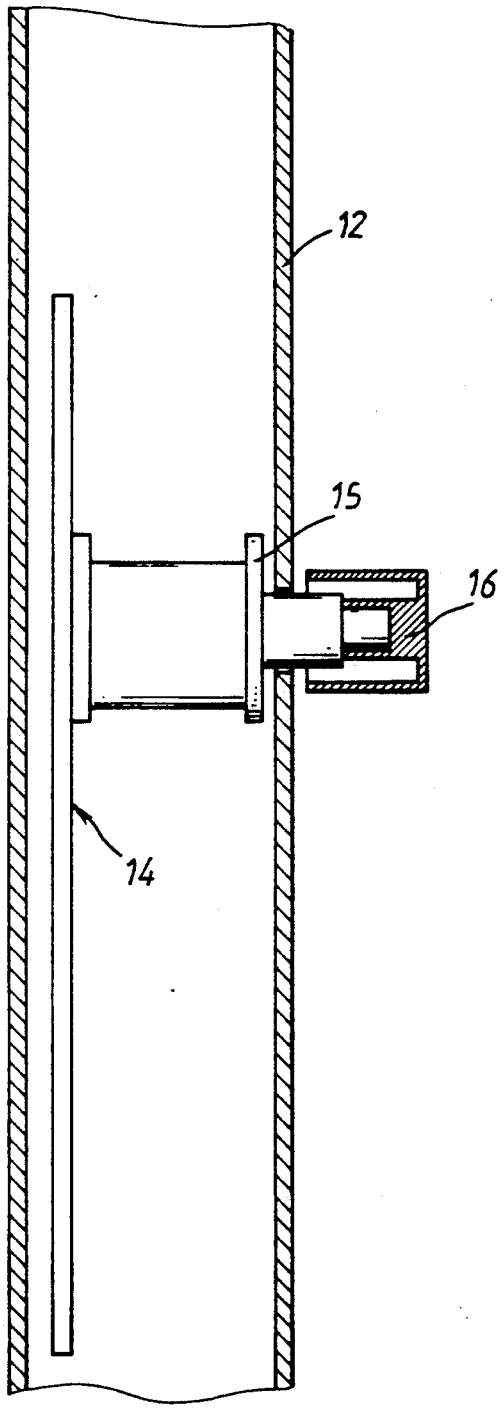
FIG. 2 (PRIOR ART)
FIG. 2 is a cross-sectional drawing showing an approximate configuration of electronic components comprising a conventional knob-type dimmer, simplified by not including certain other components typically utilized.
Figure 3:
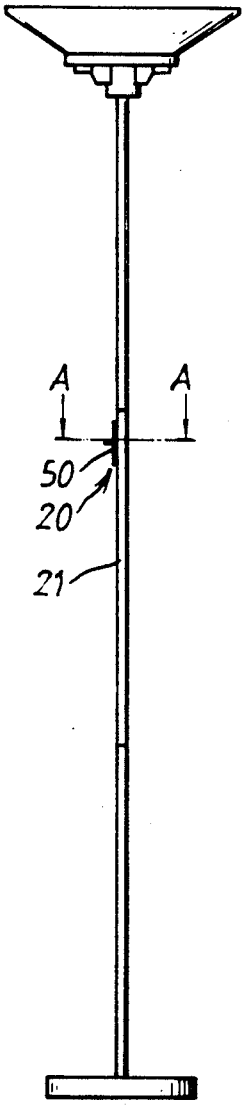
FIG. 3 is an orthographic drawing of dimmer invention herein as installed in a floor lamp.

Referring now to FIG. 3, the dimmer (20) invention herein shall be explained. As indicated in FIG. 3, the dimmer (20) is installed in an ideal location inside the column (21) of the floor lamp, with the control bolt (50), which serves as a power switch and brightness adjuster, of the dimmer (20) protruding through the outer wall of column (21).

Figure 5:
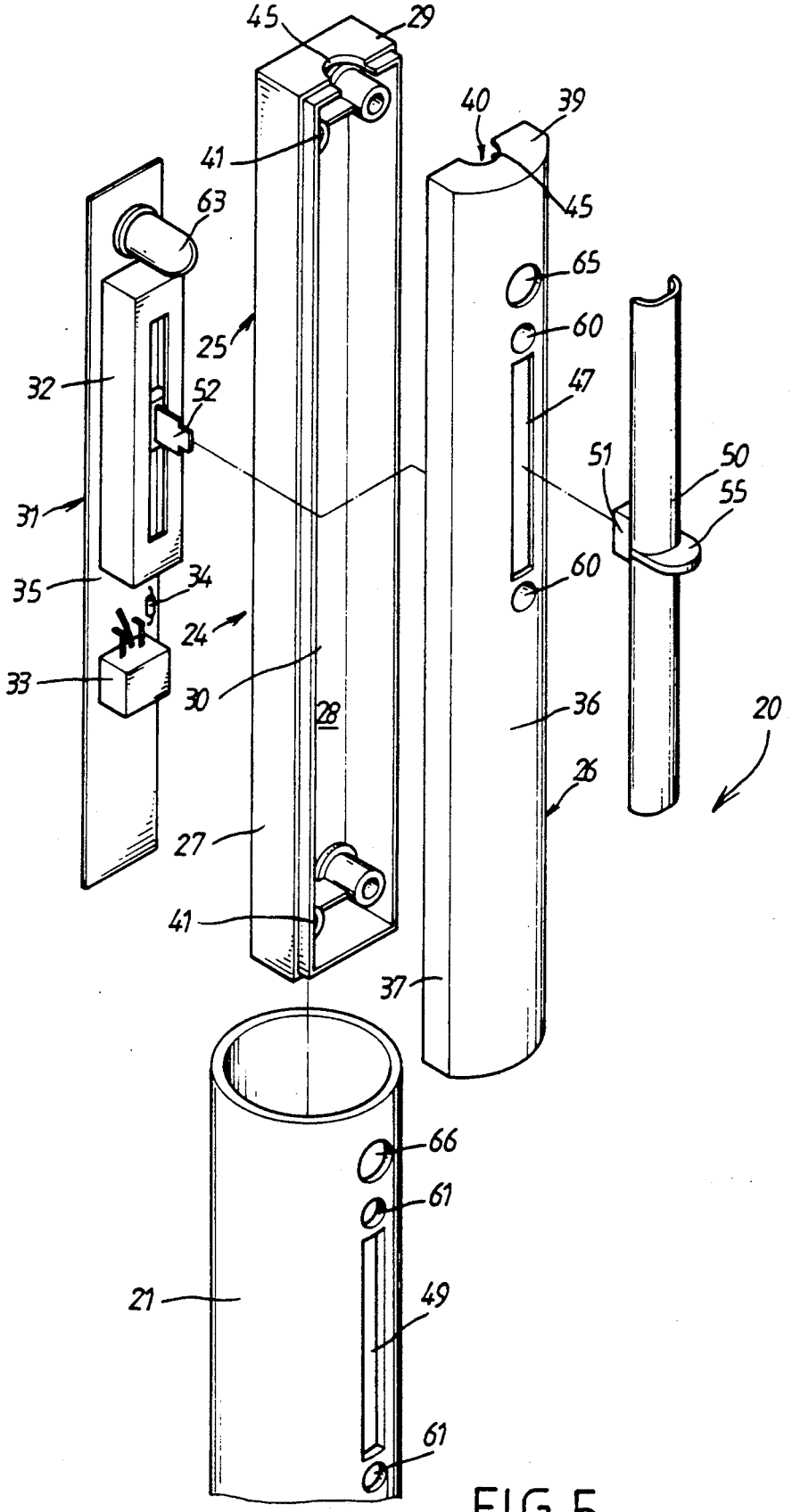
FIG. 5 is an exploded drawing of the invention herein which illustrates the structural configuration of the individual components, including the column of the floor lamp.

Referring next to FIG. 5, the aforementioned dimmer (20) includes an oblong case half (24) which becomes a case (25) when the cover (26) is fitted onto the aforesaid case half (24); the case has two long sides (27) and two short sides (29) extending in perpendicular fashion from case bottom (28) and running along the length and width, respectively, of the case half (24); meanwhile, the recessed space (30) formed by the aforementioned sides is utilized to hold the dimmer circuit (31); the aforesaid dimmer circuit (31) consists of a rheostat (32), triac (33), diac (34) and other electronic components, which are all mounted in an electrical configuration on the printed circuit board (35). Since the dimmer circuit is based on conventional technology, no further explanation is necessary.

Figure 6:
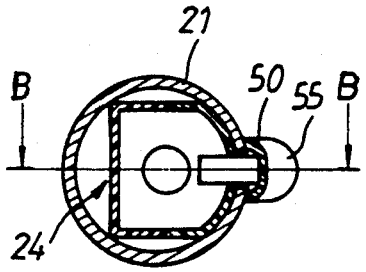
FIG. 6 is derived from FIG. 3 and is top sectional drawing of the dimmer invention herein, with line A—A indicated the bisecting point of perspective utilized for the cross-sectional view of the aforesaid dimmer installed in the column of a floor lamp.

The aforementioned cover (26) is utilized to seal the case (25) and, as indicated in FIG. 5, the cover (26) has a convex top (36), two long sides (37) and two short sides (39); each of the two short sides (39) has semicircular groove (40) which are utilized to secure the aforementioned dimmer circuit (31); with reference to the application of the invention herein, the convex top (36) of the cover (26) is shaped to fit into the concave interior surface of the column (21), as indicated in FIG. 6; the case (25) and cover (26) are fastened together with screws (43) and for this purpose there are four screw towers (41) on the opposing ends of the case bottom (28), with four tapped holes (42), congruent and contiguous to the aforesaid screw towers (41), molded onto the underside of and at both ends of the convex top (36); the alignment of the screw towers (41) with the tapped holes (42) permit the insertion and tightening of the screws (43) and, furthermore, the aforesaid screw towers (41) and tapped holes (42) are flush when the screws (43) are tightened. The case (25) and the cover (26) may also be secured together by interlocking and a number of other means.

Figure 7:
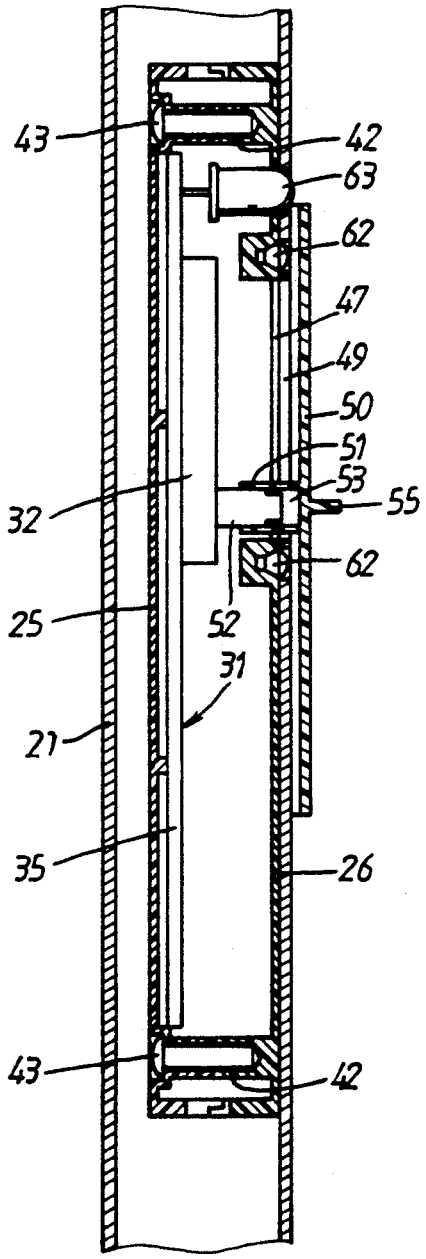
FIG. 7 is a cross-sectional view of the invention herein that shows the positional relationship of the respective components. The plane of bisection is based on line B—B in FIG. 6.

Referring once again to FIG. 5, the short sides (29) and (39) of the case (25) and the cover (26), respectively, each have semi-circular grooves (45) and (40); thus, when the case (25) and the cover (26) are assembled together, one hole is produced on each end of the assembly and the aforementioned holes are utilized to route electrical control wires (not shown in the diagram) from the dimmer circuit (31) mounted in the case half (24); the aforesaid control wires conduct electricity to the incandescent bulb (or flourescent tube) of the floor lamp. A long slot (47) is cut into the convex top (36) of the cover (26); similarly, a slot (49), identical in dimension with the aforesaid long slot (47), is machined at a predetermined location on the column (21); the slots (47) and (49) provide a tracking groove for the tongue (51) of the operating bolt (50) which is inserted onto the slide-type lever (52) of the rheostat (32) (see FIG. 7); since the operating bolt (50) and the slide-type lever (52) are assembled together, pushing the operating bolt (50) varies the resistance of the rheostat (32), enabling the control of electrical current within a given range of potential and thus the adjustment of the degree of brightness. There is a small hole (60) at each end of the long slot (47) on the cover (26) and there is a matching hole (61) at each end of the long slot (49) on the column (21); a screw (62) is tightened into each of the aforesaid small holes (60) (see FIG. 7) to fasten the case half (24) securely against the inside of the column (21) and, furthermore, since the cover (26) is made out of a resinous material and the aforementioned screws (62) are metal, the screws (62) tap into the aforementioned small holes (60).

As indicated in FIG. 5, the dimmer (20) invention herein is enhanced in that an LED indicator (63) is included in the design; the LED indicator (63) is mounted on the printed circuit board (35) and is a component of the dimmer circuit (31) which functions to emit a visible light signal; in order to allow the light of the LED indicator (63) to be visible from the outside of the floor lamp, two round windows (65) and (66) are drilled in through the cover (26) and the column (21), respectively, and size of the aforesaid windows accommodate the passage of the emitted light signal; the LED indicator (63) remains unlit when the incandescent bulb (tube) of the floor is turned on and, conversely, the LED indicator (63) is activated when the incandescent bulb (tube) is switched off, thus the LED indicator (63) not only signals the location of the floor lamp in the dark, but also the position of the dimmer (20) and this capability eliminates searching for the floor lamp and the dimmer (20) in the absence of room lighting.

Figure 4:
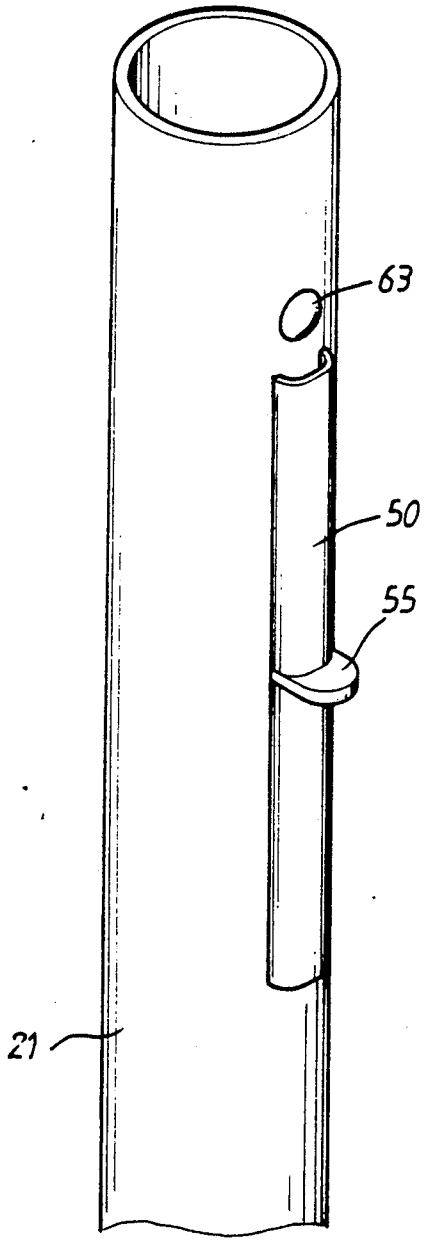
FIG. 4 is an isometric drawing magnified to illustrate the dimmer herein as installed in a section of a floor lamp column, with the protruding control tab of the dimmer shown in the lowest position.

As indicated in FIG. 5, the aforementioned operating bolt (50) is of lengthy construction and is fastened in such a way to facilitate an upward and downward movement (see FIG. 4) over the outer surface of the column (21); protruding from the underside of the operating bolt (50) is a tongue (51) which fits through the long slots (49) and (47) on the column (21) and the cover (26), respectively; formed into the bottom of the tongue (51) is a recess (53) that slips over the slide-type lever (52) of the rheostat (32) (see FIG. 7); thus, since the operating bolt (50) and the slide-type lever (52) are assembled together, the upward and downward movement of the operating bolt (50) has the effect of varying the resistance of the rheostat (32); a tab (55) protrudes from the outer surface of the operating bolt (50) to facilitate the convenient movement of the operating bolt (50) with the fingers; the convenience offered by the design of the aforesaid operating bolt (50) and other supporting features such as knurled surface of the operating bolt (50) for positive movement reflect the spirit and extent of the invention herein, thus, it is also important to know that when the operating bolt (50) is at the lowest position, the LED indicator (63) is not obstructed by the operating bolt (50) (see FIG. 4), and this enables the LED indicator (63) to signal the location of the floor lamp when the floor lamp is not switched on and, moreover, indicate the location of the operating bolt (50) without difficulty under conditions of darkness.

As indicated in FIG. 3, since the dimmer (20) of the invention herein is installed internally, the operating bolt (50) is the only part visible on the outside of the column (21) and furthermore is extremly thin and miniaturized in construction, so the operating bolt (50) can be finished in the same color as the column (21); therefore, it is difficult to visibly notice the operating bolt (50) on the column (21) and hence the attractive apperance and aesthetic design of the floor lamp can be preserved.

In addition, since the electronic components of the dimmer (20) can be enclosed in the oblong case half (24), the entire assemblage fits into a floor lamp column with a 1.5-inch or less inner diameter, including inner diameters of 1.2 inches, 1 inch or even smaller; thus, the invention herein effectively widens the possible designing parameters of floor lamps and eliminates the prior restriction to large diameter floor lamp columns.

What is claimed is:

1. A lamp having a base, a lighting fixture and a column extending between the base and the lighting fixture, comprising:

a) dimmer circuit means including a rheostat having a slidable operating lever extending therefrom;

b) mounting means to mount the dimmer circuit means within the column;

c) a slot defined by the column;

d) an operating bolt attached to the slidable operating lever through the slot such that the operating bolt is located exteriorly of the column and is movable relative to the column;

e) a visible light source located within the column; and, f) an opening defined by the column adjacent the visible light source such that light emanating from the visible light source is visible from the exterior of the column.

2. The lamp of claim 1 wherein the operating bolt further comprises means to cover the opening defined by the column during at least a portion of its movement.

3. The lamp of claim 1 wherein the slot defined by the column is generally linear.

4. The lamp of claim 1 wherein the mounting means comprises:

a) a case enclosing the dimmer circuit means;

b) a second slot defined by the case located such that the slidable operating lever extends therethrough; and, c) fastening means to fasten the case to the column.

5. The lamp of claim 4 wherein the case encloses the visible light source and further comprises a second opening defined by the case located so as to be aligned with the opening defined by the column when the case is fastened to the column.

6. The lamp of claim 1 wherein the visible light source comprises a light emitting diode (LED).

* * * * *